US010131512B2

(12) United States Patent
Tada et al.

(10) Patent No.: US 10,131,512 B2
(45) Date of Patent: Nov. 20, 2018

(54) DOCUMENT FEEDER AND IMAGE FORMING APPARATUS INCORPORATING THE DOCUMENT FEEDER

(71) Applicants: Kaoru Tada, Kanagawa (JP); Takayuki Andoh, Kanagawa (JP); Yohei Osanai, Kanagawa (JP); Tatsuaki Nagano, Kanagawa (JP); Koji Hatayama, Kanagawa (JP); Munekazu Hirata, Kanagawa (JP); Toshiyuki Horikawa, Kanagawa (JP)

(72) Inventors: Kaoru Tada, Kanagawa (JP); Takayuki Andoh, Kanagawa (JP); Yohei Osanai, Kanagawa (JP); Tatsuaki Nagano, Kanagawa (JP); Koji Hatayama, Kanagawa (JP); Munekazu Hirata, Kanagawa (JP); Toshiyuki Horikawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 99 days.

(21) Appl. No.: 15/384,868

(22) Filed: Dec. 20, 2016

(65) Prior Publication Data

US 2017/0183181 A1 Jun. 29, 2017

(30) Foreign Application Priority Data

Dec. 28, 2015 (JP) ..... 2015-255721

(51) Int. Cl.
*B65H 5/00* (2006.01)
*B65H 5/38* (2006.01)
(Continued)

(52) U.S. Cl.
CPC ..... *B65H 5/38* (2013.01); *B65H 3/0676* (2013.01); *B65H 5/062* (2013.01); *B65H 9/101* (2013.01); *B65H 9/166* (2013.01); *B65H 2801/06* (2013.01)

(58) Field of Classification Search
CPC ..... B65H 5/062; B65H 5/068; B65H 5/36; B65H 5/38
See application file for complete search history.

(56) References Cited

U.S. PATENT DOCUMENTS 7,422,205 B2 * 9/2008 Akiyama ..... B65H 3/0615 271/110
2012/0153564 A1 * 6/2012 Huang ..... B65H 5/38 271/226

(Continued)

FOREIGN PATENT DOCUMENTS

| | | |
|---|---|---|
| JP | 11-239247 | 8/1999 |
| JP | 2004-129308 | 4/2004 |
| JP | 2006-287903 | 10/2006 |

OTHER PUBLICATIONS

U.S. Appl. No. 15/187,822, filed Jun. 21, 2016.

*Primary Examiner* — Prasad V Gokhale
(74) *Attorney, Agent, or Firm* — Harness, Dickey & Pierce, P.L.C.

(57) ABSTRACT

A document feeder, which may be incorporated in an image forming apparatus, includes a sheet conveying guide, at least one recess, a frame, and at least one protrusion. The sheet conveying guide is disposed facing an exposure glass on an apparatus body and guides an original document passing over the exposure glass when the document feeder is closed to the apparatus body. The recess is disposed on the apparatus body at both ends of the exposure glass in a lateral direction orthogonal to a document conveying direction. The frame is openably closable about one end side of the (Continued)

apparatus body in the lateral direction and vertically movably holds the sheet conveying guide. The protrusion is disposed on the frame facing the recess. The sheet conveying guide and the frame are secured to each other while the recess and the protrusion are engaged with each other in the closed state.

19 Claims, 7 Drawing Sheets

(51) Int. Cl.

| | |
|---|---|
| ***B65H 3/06*** | (2006.01) |
| ***B65H 5/06*** | (2006.01) |
| ***B65H 9/10*** | (2006.01) |
| ***B65H 9/16*** | (2006.01) |

(56) References Cited

U.S. PATENT DOCUMENTS

| | | | | |
|---|---|---|---|---|
| 2012/0228822 | A1* | 9/2012 | Akiyama | B65H 5/062 271/264 |
| 2015/0341515 | A1 | 11/2015 | Youda et al. | |
| 2016/0127590 | A1 | 5/2016 | Hatayama et al. | |
| 2016/0257517 | A1* | 9/2016 | Watanabe | B65H 5/062 |
| 2016/0277624 | A1 | 9/2016 | Osanai et al. | |
| 2016/0360073 | A1 | 12/2016 | Hatayama et al. | |

* cited by examiner

DOCUMENT FEEDER AND IMAGE FORMING APPARATUS INCORPORATING THE DOCUMENT FEEDER

CROSS-REFERENCE TO RELATED APPLICATION

This patent application is based on and claims priority pursuant to 35 U.S.C. § 119(a) to Japanese Patent Application No. 2015-255721, filed on Dec. 28, 2015, in the Japan Patent Office, the entire disclosure of which is hereby incorporated by reference herein.

BACKGROUND

Technical Field

This disclosure relates to a document feeder that feeds an original document such as a paper or a recording sheet, and an image forming apparatus such as a copier, facsimile machine, printer, printing machine, and a multi-functional apparatus including at least two functions of the copier, facsimile machine, printer, and printing machine.

Related Art

Various image forming apparatuses such as a copier, a printer, a printing machine, a facsimile machine and so forth are widely known to include a document feeder that conveys an original document. The document feeder feeds an original document loaded on a document loader (for example, a document table) and causes an image reader to read image data of the original document through an exposure glass disposed on a top face of the image forming apparatus while the original document is passing over the exposure glass. Subsequently, the document feeder ejects and stacks the original document on a document ejecting portion (for example, a sheet ejection tray).

Such a known document feeder includes an automatic document feeder (ADF) disposed on an apparatus body of the image forming apparatus to be openable and closable with respect to the image forming apparatus. The known document feeder is hinged to the apparatus body of the image forming apparatus to rotate about one end side in a lateral direction (that is, a direction orthogonal to a document conveying direction) as a center of rotation.

In the document feeder, a sheet conveying guide (for example, a document pressing member or a document guide) is provided movably in a vertical direction at a position facing an exposure glass.

When the original document set on a document loader in the document feeder reaches the position of the exposure glass, the original document is conveyed between the sheet conveying guide and the exposure glass while being guided by the sheet conveying guide.

The above-described document feeder has a technique by which the sheet conveying guide is positioned with respect to the exposure glass by fitting the sheet conveying guide, which is held movably in the vertical direction in the document feeder, into recesses formed on a top face of the image forming apparatus having the exposure glass.

Such a document feeder has high accuracy in positioning an original document with a sheet conveying guide to the exposure glass. However, the accuracy of positioning the document feeder (for example, an automatic document feeder, ADF) to an apparatus body (an image reading device) of the image forming apparatus is likely to decrease.

A mechanism employing hinges to open and close the document feeder with respect to the apparatus body of the image forming apparatus is used to finely adjust the position of the document feeder relative to the apparatus body of the image forming apparatus. Such fine adjustment of the position of the document feeder takes time and effort to detach and attach the document feeder with respect to the apparatus body of the image forming apparatus for maintenance.

SUMMARY

At least one aspect of this disclosure provides a document feeder including a sheet conveying guide, at least one recess, a frame, and at least one projection. The sheet conveying guide is disposed facing an exposure glass disposed on a top face of an apparatus body of an image forming apparatus and configured to guide an original document passing over the exposure glass when the document feeder is in a closed state with respect to the apparatus body. The at least one recess are disposed on the apparatus body at both ends of the exposure glass in a lateral direction orthogonal to a document conveying direction of the original document. The frame is openably closable about one end side of the apparatus body of the image forming apparatus in the lateral direction and is configured to hold the sheet conveying guide movable in a vertical direction. The at least one protrusion is disposed on the frame at a position facing the at least one recess. The sheet conveying guide and the frame are secured to each other while the at least one recess and the protrusions respectively engaged with each other when the document feeder is in the closed state with respect to the apparatus body.

Further, at least one aspect of this disclosure provides an image forming apparatus including an apparatus body, and the above-described document feeder. The above-described document feeder is disposed on a top face of the apparatus body and openably closable about one end side of the apparatus body in a direction orthogonal to the document conveying direction.

DETAILED DESCRIPTION

Figure 1:
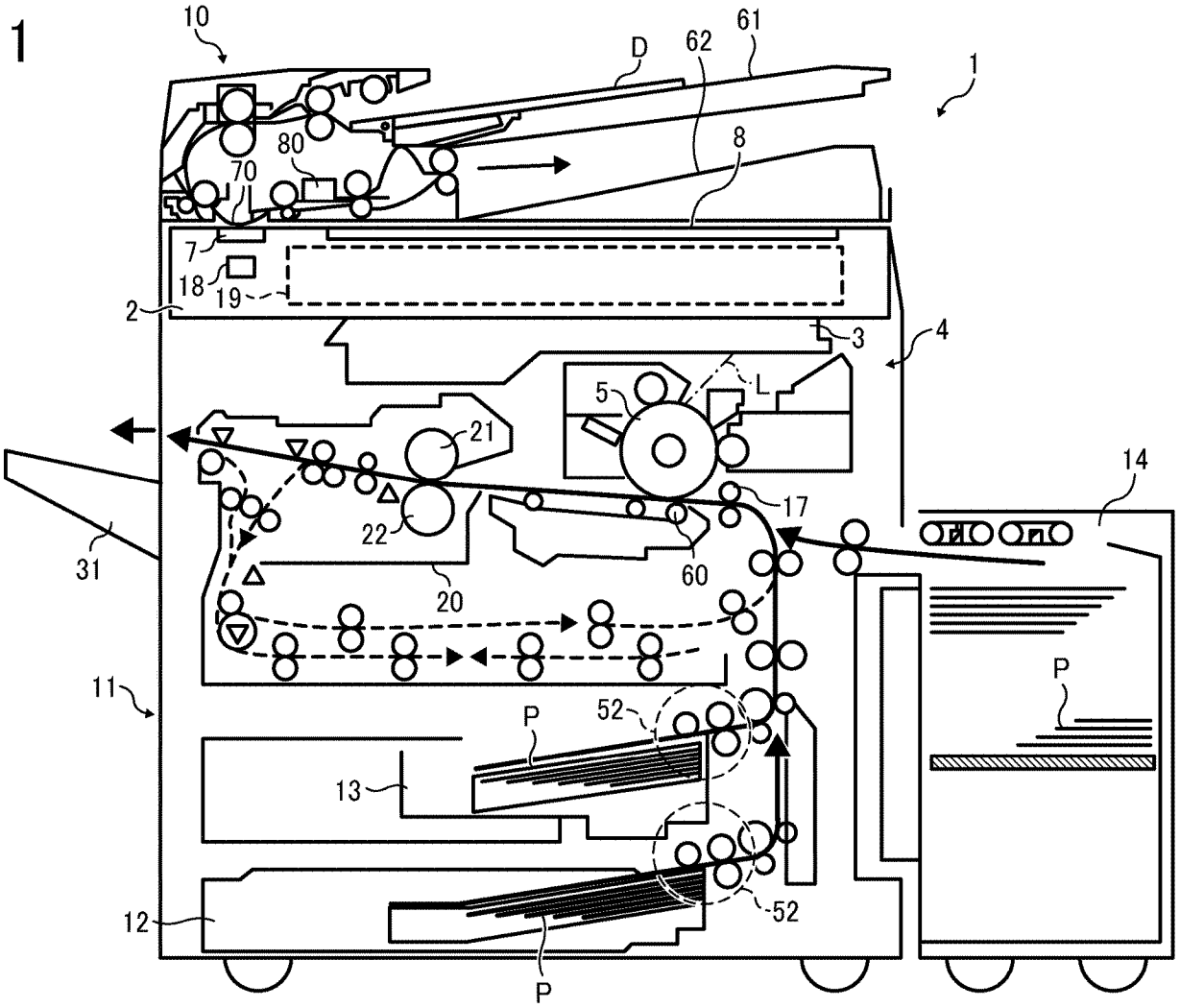
FIG. 1 is a general arrangement view illustrating an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Next, a description is given of a configuration and functions of an image forming apparatus 1 according to an embodiment of this disclosure, with reference to drawings.

It is to be noted that identical parts are given identical reference numerals and redundant descriptions are summarized or omitted accordingly.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is an electrophotographic copier that forms toner images on recording media by electrophotography.

It is to be noted in the following embodiments that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

Now, a description is given of a basic configuration and operations of the image forming apparatus 1 with reference to FIG. 1.

In FIG. 1, the image forming apparatus 1 is illustrated as a copier. The image forming apparatus 1 includes a first image reader 2, an exposure unit 3, an image forming device 4, a photoconductor drum 5, a first exposure glass 7, a second exposure glass 8, an automatic document feeder (ADF) 10, an apparatus body 11, a first sheet feeding unit 12, a second sheet feeding unit 13, a third sheet feeding unit 14, a pair of registration rollers 17, a contact image sensor (CIS) 18, a scanner 19, a fixing device 20, a fixing roller 21, a pressure roller 22, a sheet ejection tray 31, a transfer unit 60, a sheet conveying guide 70, and a second image reader 80.

The first image reader 2 optically reads image information of a front side of the original document D.

The exposure unit 3 irradiates the photoconductor drum 5 with the exposure light beam L based on the image data read by the first image reader 2 and the second image reader 80.

The image forming device 4 forms a toner image (image) on the photoconductor drum 5.

The first exposure glass 7 is an exposure glass above which the original document D automatically being conveyed by the automatic document feeder (ADF) 10 passes.

The second exposure glass 8 is an exposure glass on which the original document D is loaded manually.

The ADF 10 conveys the original document D set on a document loader 61 to the first exposure glass 7 and the second image reader 80, and then ejects the original document D to a document ejecting portion 62.

The apparatus body 11 is a housing or casing of the parts and components of the image forming apparatus 1. The ADF 10 is mounted on the apparatus body 11.

The first sheet feeding unit 12, the second sheet feeding unit 13, and the third sheet feeding unit 14 accommodate the sheet P.

The pair of registration rollers 17 (timing rollers) conveys the sheet P toward the transfer unit 60.

The CIS 18 reads the image information of the original document D through the first exposure glass 7.

The scanner 19 reads the image information of the original document D through the second exposure glass 8.

The fixing device 20 fixes the toner image (unfixed image) carried on the sheet P. The fixing roller 21 and the pressure roller 22 are provided in the fixing device 20.

The sheet ejection tray 31 is a tray on which the sheet P that has been ejected from the image forming apparatus 1 is stacked.

The transfer unit 60 (an image forming section) transfers the toner image formed on the photoconductor drum 5 to a sheet P.

The sheet conveying guide 70 (that is, the sheet conveying guide plate) guides the original document D passing above the first exposure glass 7.

The second image reader 80 (that is, the image reading unit) optically reads image information of a back side of the original document D.

Now, a description is given of regular image forming operations of the image forming apparatus 1 with reference to FIG. 1.

In the ADF 10, the original document D is conveyed (fed) from the document loader 61, and then passes the first exposure glass 7 serving as an exposure glass. Meanwhile, the CIS 18 in the first image reader 2 optically reads, through the first exposure glass 7, image information of the front side of the original document D passing above the first exposure glass 7.

Subsequently, the optical image information read by the CIS 18 (first image reader 2) is converted into an electric signal, which is then transmitted to the exposure unit 3 (writing section). Then, the exposure unit 3 irradiates the photoconductor drum 5 in the image formation unit 4 with the exposure light L, such as a laser beam, based on the image information of the electric signal.

In the image formation unit 4, the photoconductor drum 5 rotates in a clockwise direction in FIG. 1. After a predetermined image formation process (a charging step, an exposing step, and a developing step) is performed, an image (toner image) corresponding to the image information is formed on the photoconductor drum 5.

Then, the transfer unit 60 transfers the image formed on the photoconductor drum 5 onto the sheet P conveyed by the pair of registration rollers 17.

Meanwhile, the sheet P to be conveyed to the transfer unit 60 (the image forming section) is operated as follows.

First, any one of the plurality of sheet feeders 12 to 14 of the image forming apparatus 1 are selected either automatically or manually (for example, assume that the uppermost sheet feeder 12 in the image forming apparatus 1 is selected). Then, the uppermost sheet of the sheet P accommodated in the sheet feeder 12 is fed by a sheet feeding mechanism 52 (including a feed roller, a pickup roller, a backup roller, and the like), and then conveyed toward a sheet conveyance path. After the sheet P passes through the sheet conveyance path along which a plurality of sheet conveying rollers are arranged, the sheet P reaches the position of the pair of registration rollers 17.

The sheet P that has reached the position of the pair of registration rollers 17 is conveyed toward the transfer unit 60 (the image forming section) by being synchronized with the transfer unit 60 to align the position of the sheet P with the position of the image formed on the photoconductor drum 5.

The sheet P that has completed the transfer process passes the transfer unit 60, and reaches the fixing device 20 after travelling the sheet conveyance path. The sheet P that has reached the fixing device 20 is then fed between the fixing roller 21 and the pressure roller 22. The toner image is then fixed by the heat applied from the fixing roller 21 and the pressure applied from both rollers 21 and 22 (this is a fixing process). After the toner image is fixed on the sheet P through the fixing process, the sheet P is conveyed out of the portion (fixing nip) between the fixing roller 21 and the pressure roller 22. The sheet P is then ejected from the image forming apparatus 1, and stacked on the sheet ejection tray 31 as an output image.

In this way, a sequential image formation process is completed.

In a case where the image formation based on an image of the back side of the original document D is performed, in addition to the front side thereof, the original document D passes the second image reader 80 (image reading unit) after passing the first exposure glass 7 in the ADF 10. Then, the second image reader 80 optically reads the image information of the back side of the original document D passing below the second image reader 80. Similar to the image formation process based on the image of the front side, the optical image information read by the second image reader 80 is transmitted to the exposure unit 3, and then the image formation process based on that image information is performed accordingly.

Figure 2:
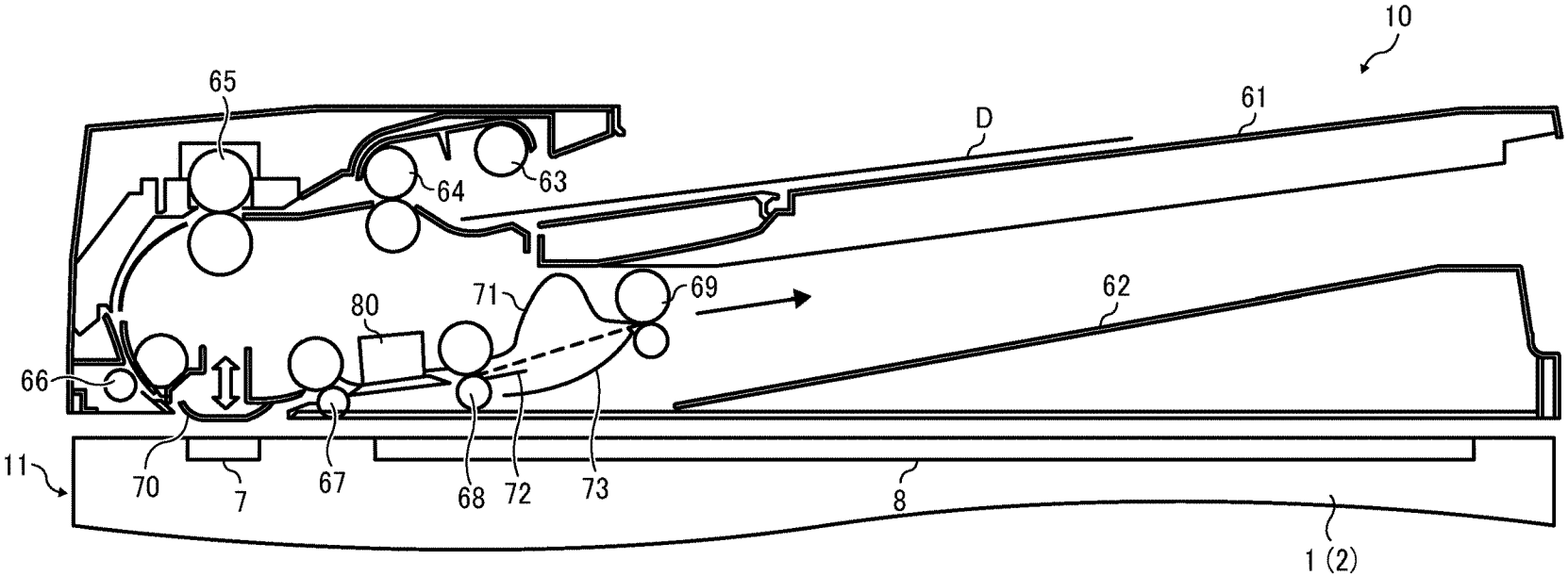
FIG. 2 is an arrangement view illustrating a document feeder according to an embodiment of this disclosure.

Next, a detailed description is given of the configuration and operations of the ADF 10 with reference to FIG. 2.

As illustrated in FIG. 2, the ADF 10 includes the document loader 61 (document table), the sheet conveying guide 70 (sheet conveying guide plate) opposite to the first exposure glass 7, the second image reader 80 (image reading unit), the document ejecting portion 62 (sheet ejection tray), a pickup roller 63, a separation/conveyance roller pair 64 (feeding roller and separation roller), a plurality of sheet conveying roller pairs 65 to 68, an ejecting roller pair 69 (sheet ejecting roller pair), a sheet conveying upper guide plate 71, sheet conveying lower guide plates 72 and 73, and the like.

The document loader 61 includes an upwardly opened space such that a user is able to load, from the upper side thereof, an original document D with the front side facing up (the document loader 61 has a structure such that a bundle of a plurality of original documents D can be stacked thereon).

The document ejecting portion 62 is provided below the document loader 61, and has a structure such that the original document D is ejected and placed thereon after the image thereof is read by the image readers 2 and 80 (the document ejecting portion 62 has a structure such that a plurality of original documents D are stacked thereon).

Along the sheet conveyance path between the document loader 61 and the document ejecting portion 62, a pickup roller 63, a separation/conveyance roller pair 64, a first sheet conveying roller pair 65 (abutment roller pair), a second sheet conveying roller pair 66 (read inlet roller pair), a third sheet conveying roller pair 67 (first read outlet roller pair), a fourth sheet conveying roller pair 68 (second read outlet roller pair), and an ejecting roller pair 69 are provided in order from the upstream side of the sheet conveyance direction. These rollers 63 to 69 function as conveyance rollers that convey the original document D loaded on the document loader 61 toward the positions of the first exposure glass 7 and the second image reader 80, and then toward the document ejecting portion 62 after the image of the original document D is read.

Moreover, as illustrated in FIG. 2, the sheet conveyance path formed with these rollers 63 to 69 includes a plurality of guide plates arranged substantially in parallel to one another on the side facing the front side of the original document D and on the side facing the back side of the original document D. These guide plates guide the conveyance of the original document D.

To be more specific, in the present embodiment, the sheet conveying guide 70 (sheet conveying guide plate) is arranged such that while the ADF 10 is in a closed state with respect to the apparatus body 11 of the image forming apparatus 1 (the state illustrated in FIGS. 1 and 2), the sheet conveying guide 70 faces the first exposure glass 7 (exposure glass) secured and held so as to be exposed on the top face of the apparatus body 11 of the image forming apparatus 1, and guides the original document D being conveyed between the first exposure glass 7 and the sheet conveying guide 70.

The sheet conveying guide 70 is held movably in the vertical direction (the directions indicated by white arrows in FIG. 2) on a unit frame 103 (casing) of the ADF 10. Specifically, a front side plate 101 and a rear side plate 102 function as part of the unit frame 103 (casing) of the ADF 10. In each of the front side plate 101 and the rear side plate 102, a long hole is formed such that the longitudinal direction thereof is in the vertical direction. Shafts rising from both side plates of the sheet conveying guide 70 are inserted into the respective long holes through bearings, whereby the sheet conveying guide 70 is arranged between the front side plate 101 and the rear side plate 102. Furthermore, guides are formed on both of the front side plate 101 and the rear side plate 102. These guides restrict the movement of the sheet conveying guide 70 in such a manner that the sheet conveying guide 70 does not rotate about the above-described shafts while moving in the vertical direction. In addition, a spring that presses the sheet conveying guide 70 toward the first exposure glass 7 (downward) is connected to the sheet conveying guide 70.

With this arrangement, the sheet conveying guide 70 for guiding the conveyance of the original document D passing over the first exposure glass 7 can be moved in the vertical direction. As a result, even when the original document D passing over the first exposure glass 7 is a thick or elastic piece of paper, the sheet conveying guide 70 moves upward according to the resistance of the paper, as appropriate. Consequently, the conveyance load of the original document D to be generated between the first exposure glass 7 and the sheet conveying guide 70 can be reduced.

The plurality of sheet conveying roller pairs 65 to 68 (specifically, the three sheet conveying roller pairs 66 to 68 relating to the reading accuracy at the positions of the first exposure glass 7 and the second image reader 80) convey the original document D at a predetermined conveyance speed (constant speed) at the positions of the first exposure glass 7 and the second image reader 80. The first exposure glass 7 is arranged so as to face the front side of the original document D on the sheet conveyance path between the second sheet conveying roller pair 66 (read inlet roller pair) and the third sheet conveying roller pair 67 (first read outlet roller pair). The second image reader 80 is arranged so as to face the back side of the original document D on the sheet conveyance path between the third sheet conveying roller pair 67 and the fourth sheet conveying roller pair 68 (second read outlet roller pair).

The ejecting roller pair 69 is arranged at the position of a document ejecting port, which is in the downstream side of the sheet conveyance direction with respect to the fourth sheet conveying roller pair 68. The fourth sheet conveying roller pair 68 is arranged in the lowermost downstream side of the sheet conveyance direction among the plurality of sheet conveying roller pairs 65 to 68. After the image of the original document D is read at the positions of the first exposure glass 7 and the second image reader 80, the ejecting roller pair 69 conveys and ejects (stacks) the original document D toward the document ejecting portion 62.

In the present embodiment, the second image reader 80 serves as an image reading unit. The second image reader 80 is provided in the ADF 10 such that the second image reader 80 can be detached therefrom, and the detachment direction thereof is in the lateral direction (the vertical direction in FIG. 2) orthogonal to the direction in which the original document D is conveyed.

Figure 4:
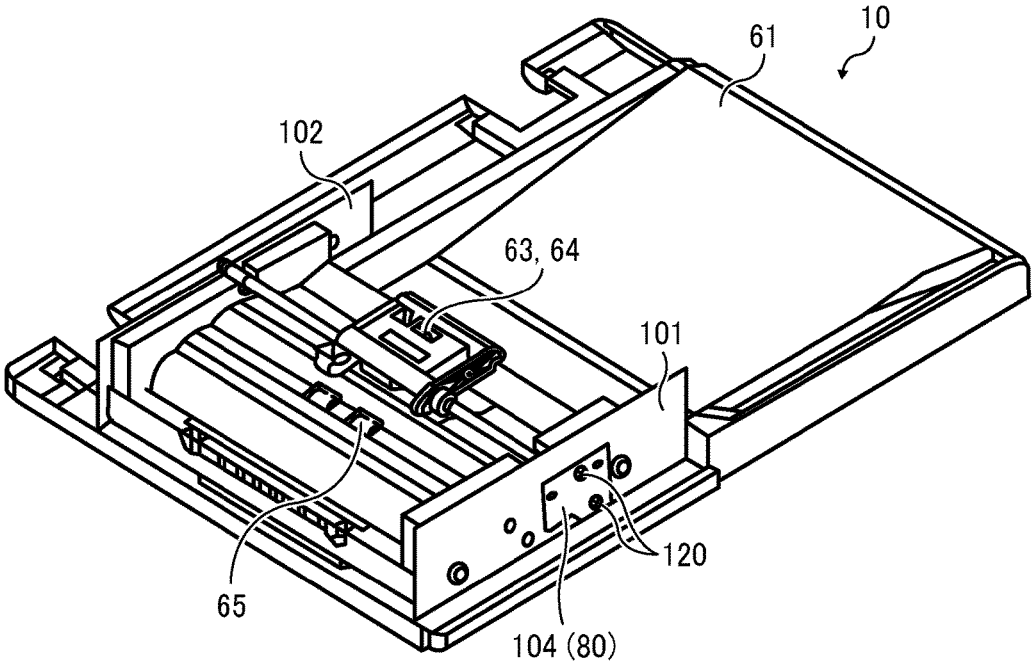
FIG. 4 is a perspective view illustrating an interior of the document feeder according to an embodiment of this disclosure.
Figure 5:
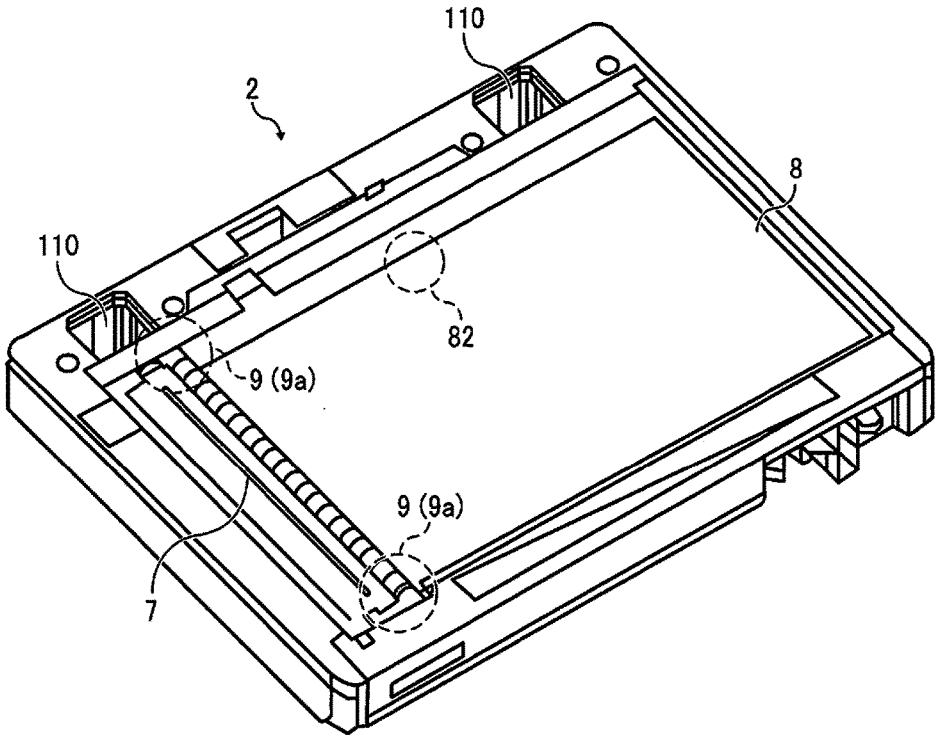
FIG. 5 is a perspective view illustrating an image reader of the image forming apparatus according to an embodiment of this disclosure, viewed from the top.
Figure 6A:
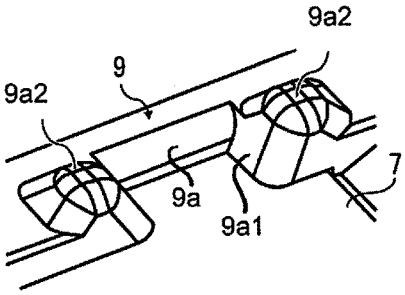
FIG. 6A is an enlarged perspective view illustrating a recess at one end side in a lateral direction according to an embodiment of this disclosure.
Figure 6B:
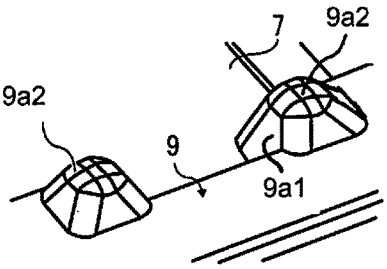
FIG. 6B is an enlarged perspective view illustrating a recess at the other end side in the lateral direction according to an embodiment of this disclosure.

Specifically, the second image reader 80 includes a CIS, an exposure glass, a housing, a face plate, and the like. As illustrated in FIG. 4, the second image reader 80 is disposed between the two side plates 101 and 102. The two side plates 101 and 102 are provided on both ends in the lateral direction, so as to function as part of the casing of the ADF 10. More specifically, the second image reader 80 includes a boss formed on one end side in the lateral direction (the back side in the attachment direction, which is in the left side in FIG. 4). The second image reader 80 is positioned by engaging the boss with a hole on the rear side plate 102, and then screwing screws 120 into female screws on the front side plate 101 through positioning holes on the face plate 104 formed in the other end side in the lateral direction (the front side in the attachment direction, which is in the right side in FIG. 4).

When the second image reader 80 is maintained or replaced, the second image reader 80 is detached from the ADF 10 in the lateral direction, with the screws 120 on the face plate 104 removed therefrom.

Figure 3:
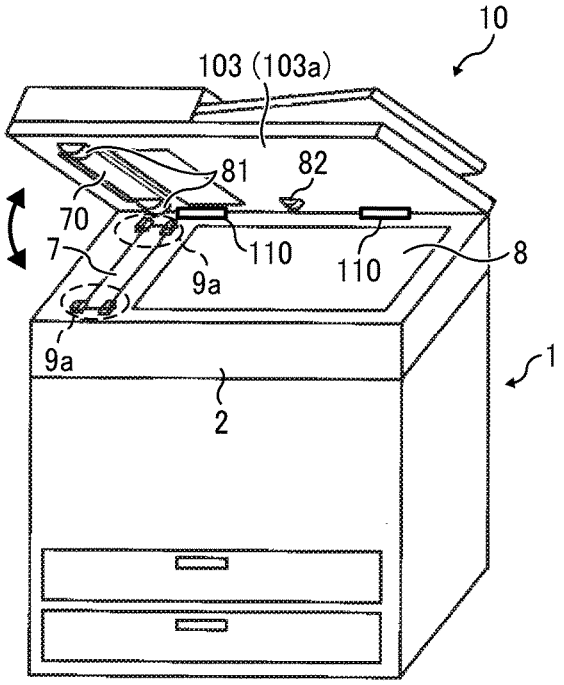
FIG. 3 is a schematic perspective view illustrating the document feeder being opened with respect to the image forming apparatus according to an embodiment of this disclosure.

Now, referring to FIG. 3 and the like, in the present embodiment, the ADF 10 is provided so as to be openable and closable with respect to the apparatus body 11 of the image forming apparatus 1 on one end side in the lateral direction (direction orthogonal to the direction in which the original document D is conveyed) as the center of turn.

Specifically, the image forming apparatus 1 includes, on one end in the lateral direction thereof, hinges 110 coupling the ADF 10 and the image forming apparatus 1 turnably in the directions indicated by a bidirectional arrow in FIG. 3. While a holder formed in the ADF 10 is held by a user, the ADF 10 is operated to the opened state, as illustrated in FIG. 3, or to the closed state, as illustrated in FIGS. 1 and 2. As described above, in a case where the image forming operation is performed by using the ADF 10 to automatically convey the original document D, the ADF 10 remains in the closed state as illustrated in FIGS. 1 and 2 without being opened and closed. In a case where the image forming operation is performed without using the ADF 10 and the original document D is manually set, the ADF 10 is opened and closed.

Referring to FIGS. 2, 3, and the like, the first exposure glass 7 and the second exposure glass 8 are formed of a light transmission material such as a transparent glass, and a publicly known material can be used therefor.

The surface of the first exposure glass 7 functions as an image reading face (document conveyance face). More specifically, the original document D being conveyed along the first exposure glass 7 is irradiated with light by the light emitting section of the CIS 18 through the first exposure glass 7. The light reflected off the original document D is then received by the light receiving section of the CIS 18 through the first exposure glass 7. In this manner, the image information of the original document D is read by the CIS 18. By contrast, the surface of the second exposure glass 8 functions as a document loading face. More specifically, in a case where the original document D is manually set by the user, the ADF 10 is opened and closed such that the second exposure glass 8 is exposed. When the original document D is set and a copy button is pressed, the scanner 19 reads the image information of the original document D set on the second exposure glass 8.

Next, a description is given of basic operations of the ADF 10 arranged as above.

First, the original document D (at least the front side thereof including an image) is stacked with the front side facing up on the document loader 61. When an instruction (copy instruction) is given to read an image of the original document D by an operation of an operation panel, the pickup roller 63 sequentially conveys the original documents D toward the separation/conveyance roller pair 64 from the upper original document D stacked on the document loader 61. Meanwhile, more than one original document D may possibly be conveyed toward the separation/conveyance roller pair 64 at a time. However, a feed reverse roller (FRR) system employed by the separation/conveyance roller pair 64 allows the separation of sheets, whereby the uppermost original document D is separated therefrom and conveyed toward the downstream side of the sheet conveyance path.

After that, the original document D conveyed to the sheet conveyance path abuts against a nip of the first sheet conveying roller pair 65 (abutment roller pair) that has stopped the rotation, and then the skew of the original document D is corrected (skew correction) therein.

Subsequently, the skew-corrected original document D is conveyed to the downstream side by the first sheet conveying roller pair 65 that has commenced rotation. After the original document D passes a document detection sensor (registration sensor), the original document D is conveyed by the second sheet conveying roller pair 66 to the position of the first exposure glass 7 while being guided by the sheet conveying guide 70. Then, the image of the front side of the original document D is optically read by the CIS 18 at the position of the first exposure glass 7.

After the image of the original document D is read, the original document D is conveyed to the position of the second image reader 80 by the second sheet conveying roller pair 66 and the third sheet conveying roller pair 67. Then, the image of the back side of the original document D is optically read at the position of the second image reader 80. In a case where the image information of the back side of the original document D is not read (the mode is set to read only the image information of the front side), the above-described image reading of the original document D by the second image reader 80 is not performed, and the original document D passes the second image reader 80.

Subsequently, the original document D is conveyed to the position of the ejecting roller pair 69 by the third sheet conveying roller pair 67 and the fourth sheet conveying roller pair 68. The original document D conveyed by the ejecting roller pair 69 is then ejected on the document ejecting portion 62.

In a case where a plurality of original documents D are stacked on the document loader 61 and image formation is performed for these original documents D, the plurality of original documents D on the document loader 61 are conveyed continuously at intervals, and the above-described sequential document conveyance operation is repeated.

In a known document feeder, while an original document or original documents can be positioned highly accurately by a sheet conveying guide to the exposure glass, the accuracy of positioning the known document feeder (for example, an automatic document feeder, ADF) to the apparatus body (the image reading device) of the image forming apparatus may decrease. Consequently, an original document that is conveyed by the document feeder is slanted to the apparatus body (the image reading device) of the image forming apparatus, which results in image misreading in which the image reading device fails to read image data of the original document correctly.

By adjusting the hinges to open and close the document feeder with respect to the apparatus body of the image forming apparatus, the position of the document feeder relative to the apparatus body of the image forming apparatus can be finely adjusted. In such a case, however, adjustment of the position of the document feeder is a time-consuming task. At the same time, the position of the document feeder is adjusted each time the document feeder is detached from and attached to the apparatus body for maintenance.

Next, a detailed description is given of a characteristic configuration and operations of the ADF 10 according to the present embodiment, with reference to FIGS. 3 to 10B and the like.

As previously described by referring to FIG. 2 and the like, the sheet conveying guide 70 (sheet conveying guide plate) opposite to the first exposure glass 7 is held movably in the vertical direction on the unit frames 101 to 103 (casing) of the ADF 10.

Referring to FIG. 3 and the like, in the present embodiment, the unit frame 103 includes a protrusion 81 provided on each end side in the lateral direction thereof. While the ADF 10 is in the closed state with respect to the apparatus body 11 of the image forming apparatus 1 (the closed state illustrated in FIGS. 1 and 2), each protrusion 81 is fit into a recess 9*a* formed on each corresponding end in the lateral direction of the first exposure glass 7 (exposure glass) in the apparatus body 11 of the image forming apparatus 1.

Specifically, referring to FIGS. 3, 5, 6A, 6B, 9, 10A, and the like, each of the recesses 9*a* in the image forming apparatus 1 includes two inwardly protruding portions. The two inwardly protruding portions are formed so as to straddle the first exposure glass 7 in the direction orthogonal to the lateral direction (the left-right direction in FIGS. 9, 10A and 10B). Each inwardly protruding portion includes, from the upper side to the lower side thereof, a sloped face 9*a*1 formed in a direction approaching the first exposure glass 7. That is, the two inwardly protruding portions and the first exposure glass 7 form the substantially V-shaped recess 9*a*.

In the present embodiment, the recesses 9*a* are formed in a support 9 (a retaining plate) holding the first exposure glass 7 on the top face of the apparatus body 11 of the image forming apparatus 1. The support 9 is formed of a resin material. In this way, the recesses 9*a* can be easily and accurately positioned with respect to the first exposure glass 7 that is detachably provided in the apparatus body 11 of the image forming apparatus 1.

Although the recesses 9*a* are formed in the support 9, the recesses 9*a* can also be formed directly in an exterior that forms the top face of the apparatus body 11 of the image forming apparatus 1.

Furthermore, referring to FIGS. 3, 7A, 7B, 8A, 8B, 9, 10A, and the like, the protrusions 81 in the ADF 10 are formed in a substantially semicircular shape. The protrusions 81 are arranged such that while the ADF 10 is closed (the closed state) with respect to the apparatus body 11 of the image forming apparatus 1, each protrusion 81 contacts the sloped faces 9*a*1 of the corresponding recess 9*a* (two inwardly protruding portions), and at the same time, contacts the first exposure glass 7 outside the range in which the original document D (original document D in the largest conveyable size) is to be conveyed, and at one end side or the other end side in the lateral direction of the first exposure glass 7. More specifically, referring to FIG. 9 and the like, the top of the protrusion 81 is in contact with the first exposure glass 7, while both sides thereof are in contact with the respective sloped faces 9*a*1 of the recess 9*a* (two inwardly protruding portions). In this way, not only the position in the direction orthogonal to the lateral direction (the left-right direction in FIG. 9) and the position in the rotating direction (the direction of rotation parallel to the surface of the first exposure glass 7), but the position in the vertical direction is also determined.

In the present embodiment, the protrusion 81 is directly provided on a base face 103*a* of the unit frame 103. However, the protrusion 81 can also be provided indirectly on the unit frame 103. More specifically, the protrusion 81 can also be formed on a cover secured and held on the unit frame 103.

As described above, in the present embodiment, the recesses 9*a* are secured and provided on the respective ends in the lateral direction of the first exposure glass 7 in the apparatus body 11 of the image forming apparatus 1, while the protrusions 81 to be fit into the recesses 9*a* are secured and provided in the ADF 10. Therefore, the ADF 10 itself can be accurately positioned with respect to the apparatus body 11 of the image forming apparatus 1 (first exposure glass 7) without adjusting, for example, the position of the hinges 110 for allowing the ADF 10 to be opened and closed with respect to the apparatus body 11 of the image forming apparatus 1. Furthermore, in the ADF 10, the sheet conveying guide 70 opposite to the first exposure glass 7 is held movably in the vertical direction on the unit frame 103 in which the protrusions 81 that serve as positional references with respect to the first exposure glass 7 are formed. Therefore, the sheet conveying guide 70 can also be positioned with respect to the first exposure glass 7 with higher accuracy.

As a result, this arrangement surely reduces an issue of preventing the first image reader 2 (CIS 18) from accurately reading the image information of the original document D. Such an issue occurs, for example, when the original document D being conveyed by the ADF 10 is obliquely conveyed to the position of the first exposure glass 7 (CIS 18) or the original document D conveyed to the position of the first exposure glass 7 is conveyed and guided obliquely by the sheet conveying guide 70.

Figure 9:
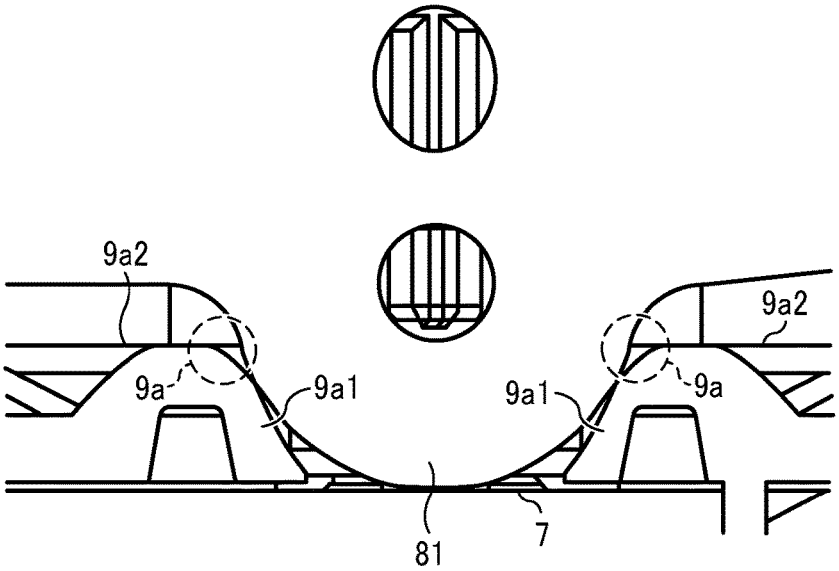
FIG. 9 is a side view illustrating the projection in the document feeder and the recess in the image forming apparatus fitting each other according to an embodiment of this disclosure.
Figure 10A:
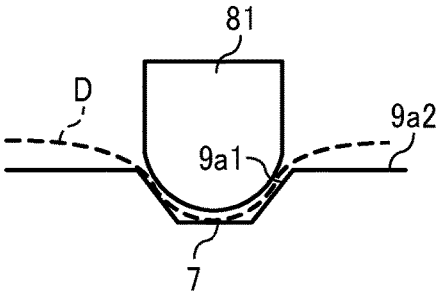
FIG. 10A is a schematic view illustrating an original document being caught between the projection and the recess in an embodiment of this disclosure.

Specifically, in the present embodiment, as previously described by referring to FIGS. 9, 10A, and the like, the protrusion 81 has a structure such that when the protrusion 81 is fit into the recess 9*a*, the top of the protrusion 81 contacts the first exposure glass 7, while both sides thereof contact the respective sloped faces 9*a*1 of the recess 9*a* (two inwardly protruding portions). Therefore, the protrusion 81 can be easily fit into the recess 9*a*, whereby the fit position is also determined easily.

Figure 10B:
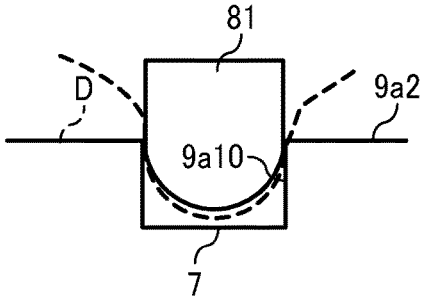
FIG. 10B is a schematic view illustrating the original document being caught between the projection and the recess in a comparative configuration.

Moreover, as illustrated in FIG. 10B, there is a case where the recess 9*a* is formed in a substantially rectangular shape so as to form vertical faces 9*a*10 therein, instead of the sloped faces 9*a*1. In such a case, when the original document D supposed to be set on the second exposure glass 8 is mistakenly set to cover an end in the lateral direction of the first exposure glass 7 and then the ADF 10 is operated from the opened state to the closed state, the original document D may be held between the recess 9*a* and the protrusion 81. In this case, the original document D can be easily torn by a knife edge formed between the vertical faces 9*a*10 and the protrusion 81. By contrast, as illustrated in FIG. 10A, the arrangement according to the present embodiment does not form a knife edge between the sloped faces 9*al* and the protrusion 81. Therefore, even when the original document D supposed to be set on the second exposure glass 8 is mistakenly set to cover an end in the lateral direction of the first exposure glass 7 and then the ADF 10 is operated from the opened state to the closed state, the original document D may be held between the recess 9*a* and the protrusion 81, but the issue of tearing the original document D is less likely to occur.

To be more specific, referring to FIG. 9 and the like, in the present embodiment, boundary portions (portions circled by broken lines in FIG. 9) between the sloped faces 9*a* 1 and top faces 9*a*2 in the recess 9*a* (two inwardly protruding portions) are formed substantially in an R shape or a curved shape. In this way, the above-described effects in which the protrusion 81 can be easily fit into the recess 9*a* (the effect of fitting the protrusion 81 such that the protrusion 81 is drawn into the recess 9*a*), and in which the issue of tearing the original document D is less likely to occur, are further ensured.

Figure 7A:
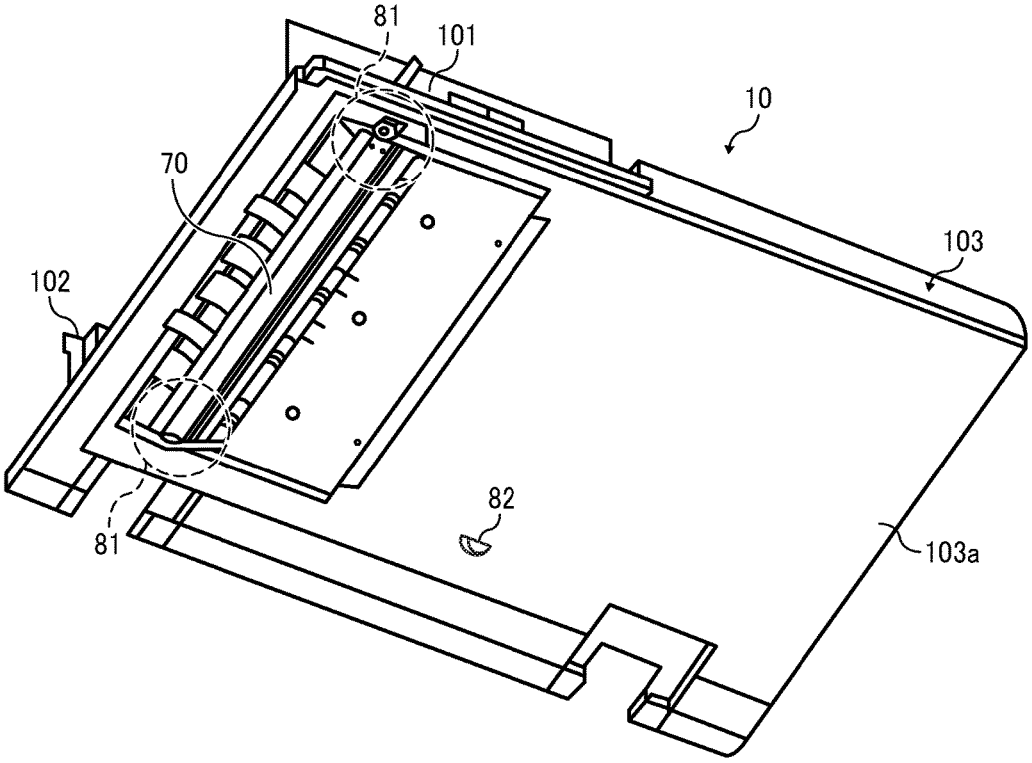
FIG. 7A is a perspective view illustrating the document feeder, viewed from below.
Figure 7B:
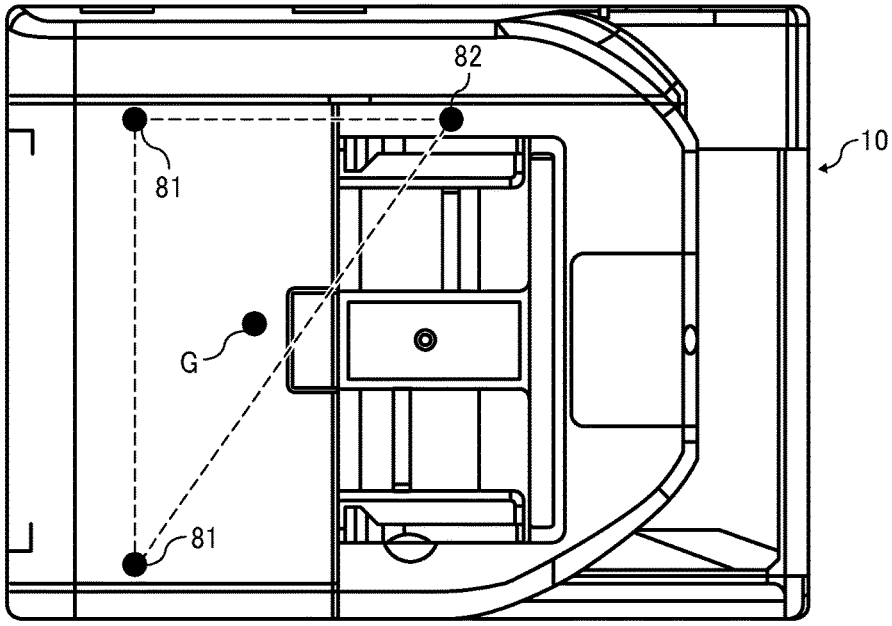
FIG. 7B is a top view illustrating the document feeder of FIG. 7A.
Figure 8A:
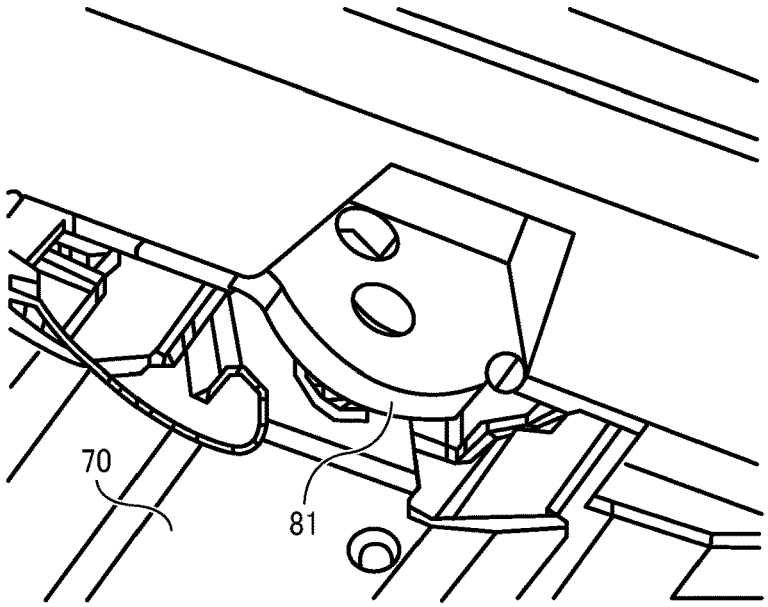
FIG. 8A is an enlarged perspective view illustrating a projection at the other end side in the lateral direction according to an embodiment of this disclosure.
Figure 8B:
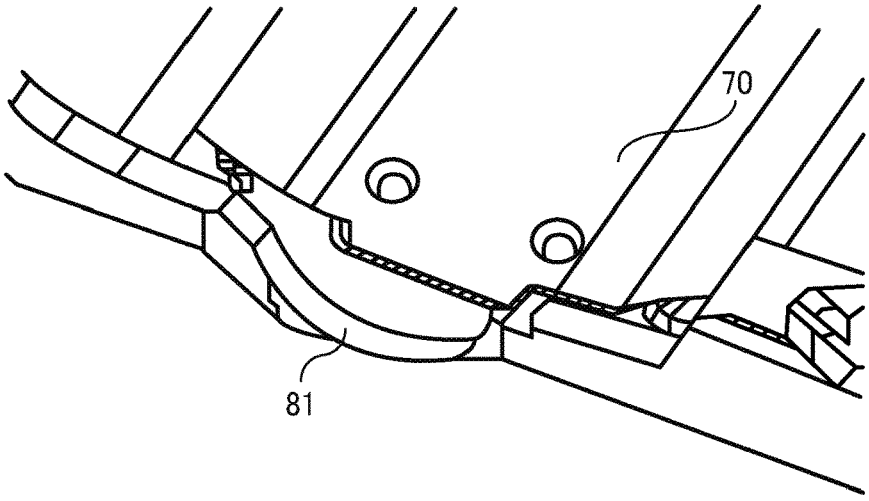
FIG. 8B is an enlarged perspective view illustrating the projection at one end side in the lateral direction according to an embodiment of this disclosure.

Now, referring to FIGS. 3, 7A, 7B and the like, in addition to the two protrusions 81, a substantially semicircular projection 82 is provided in the ADF 10 according to the present embodiment.

Specifically, the two protrusions 81 are provided on the base face 103*a* of the unit frame 103 opposite to the top face of the apparatus body 11 of the image forming apparatus 1, and positioned at one end side in the longitudinal direction (the left-right direction in FIG. 7B) orthogonal to the lateral direction of the ADF 10. By contrast, the projection 82 is provided on the base face 103*a* of the unit frame 103, and positioned at the other end side away from the one end side in the longitudinal direction. Similar to the two protrusions 81, the projection 82 is in contact with the top face of the apparatus body 11 of the image forming apparatus 1 while the ADF 10 is in the closed state with respect to the apparatus body 11 of the image forming apparatus 1. That is, the ADF 10 is supported by three points including the two protrusions 81 and the projection 82 on the top face of the apparatus body 11 of the image forming apparatus 1.

By supporting the ADF 10 with respect to the apparatus body 11 of the image forming apparatus 1 with these three points, the ADF 10 itself and the sheet conveying guide 70 can be positioned with respect to the apparatus body 11 of the image forming apparatus 1 (the first exposure glass 7) with higher accuracy.

Referring to FIG. 7B, in the present embodiment, a center of gravity G of the ADF 10 is positioned so as to be within a virtual triangle (a triangle depicted by a broken line in FIG. 7B), when the ADF 10 is seen from above, while the ADF 10 is in the closed state with respect to the apparatus body 11 of the image forming apparatus 1. The virtual triangle is formed from the three points including the two protrusions 81 and the projection 82.

This arrangement allows the three points including the two protrusions 81 and the projection 82 to contact the top face of the apparatus body 11 of the image forming apparatus 1 in a stable and balanced manner. Accordingly, the effect of the above-described three-point support is further ensured.

In order to further ensure such an effect, it is preferable that the geometric center of gravity of the three points including the two protrusions 81 and the projection 82 illustrated in FIG. 7B is positioned so as to match the center of gravity G of the ADF 10.

In addition, in the present embodiment, the projection 82 is arranged so as to contact the second exposure glass 8 outside the range thereof in which the original document D is to be loaded and at one end side in the lateral direction of the second exposure glass 8 (the side that is opposite to the user operation side, and on which the hinges 110 are provided). The second exposure glass 8 is provided separately from the first exposure glass 7 on the top face of the apparatus body 11 of the image forming apparatus 1.

In this manner, it is possible to reduce an issue of the original document D being damaged by coming into contact with the projection 82 when the original document D is loaded on the second exposure glass 8.

As described above, the ADF 10 according to the present embodiment includes the unit frame 103. The unit frame 103 holds the sheet conveying guide 70 movably in the vertical direction, which guides the original document D being conveyed between the first exposure glass 7 (exposure glass) and the sheet conveying guide 70, and includes the protrusions 81 secured and provided on both end sides in the lateral direction of the unit frame 103. While the ADF 10 is in the closed state with respect to the apparatus body 11 of the image forming apparatus 1, the protrusions 81 are fit into the recesses 9*a* formed on their respective ends in the lateral direction of the first exposure glass 7 in the apparatus body 11 of the image forming apparatus 1.

As a result, while the arrangement is relatively simple, the ADF 10 can be positioned accurately with respect to the apparatus body 11 of the image forming apparatus 1, whereby the sheet conveying guide 70 can also be positioned accurately with respect to the first exposure glass 7 without adjusting the positions.

In the present embodiment, this disclosure is applied to the ADF 10 provided on the monochrome image forming apparatus 1. However, this disclosure is naturally applicable to a document feeder provided on a color image forming apparatus as well.

In addition, in the present embodiment, this disclosure is applied to the ADF 10 provided on the electrophotographic-type image forming apparatus 1. However, this disclosure is not limited to this application, and is applicable to a document feeder provided on another type of image forming apparatus (e.g., an inkjet image forming apparatus and a stencil printing machine).

Even in such an arrangement, similar effects to the present embodiment can be attained as well.

It is to be understood that this disclosure is not limited to the present embodiment, and the embodiment may be modified suitably beyond the range suggested in the present embodiment, within the technical concept of this disclosure. Furthermore, the numbers, positions, shapes, and the like, of the constituent members described above are not limited to those described in the present embodiment, and suitable numbers, positions, shapes, and the like, can be adopted in implementing this disclosure.

In this application, "original document" defined herein includes not only an original document formed of paper, but also any original document formed of a sheet-like member such as an overhead projector (OHP) sheet.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A document feeder comprising:

a sheet conveying guide disposed facing an exposure glass disposed on a top face of an apparatus body of an image forming apparatus and configured to guide an original document passing over the exposure glass when the document feeder is in a closed state with respect to the apparatus body;

at least two recesses disposed on the apparatus body at both ends of the exposure glass, each of the at least two recesses respectively being formed by a pair of first protrusions;

a frame, openable and closable about one end side of the apparatus body of the image forming apparatus, the frame being configured to hold the sheet conveying guide such that the sheet conveying guide is movable in a vertical direction; and at least two second protrusions disposed on the frame, each respectively disposed at a position facing a respective one of the at least two recesses, each of the at least two second protrusions being configured to be fitted and positioned between the pair of first protrusions of a respective one of the at least two recesses when the document feeder is in the closed state with respect to the apparatus body.

2. The document feeder according to claim 1, wherein the frame includes a base face disposed facing the top face of the apparatus body, wherein the at least two second protrusions are disposed on the base face of the frame, at one end side in a document conveying direction perpendicular to the lateral direction, and wherein the frame includes a projection disposed on the base face of the frame, at a position separated from the at least two second protrusions disposed on the one end side toward an opposed end side in the document conveying direction, and wherein the projection is configured to contact the top face of the apparatus body when the document feeder is in the closed state with respect to the apparatus body.

3. The document feeder according to claim 2, wherein wherein a center of gravity of the document feeder falls within a region of a virtual triangle formed by connecting three points including the at least two second protrusions and the projection, viewed from above, when the document feeder is in the closed state with respect to the apparatus body.

4. The document feeder according to claim 2, wherein the exposure glass includes a first exposure glass, wherein the document feeder further comprising a second exposure glass disposed on the top face of the apparatus body, at a position separated from the first exposure glass, and wherein the projection is disposed at one end side in the lateral direction of the second exposure glass, and is configured to contact an outside area of the region on which the original document is loaded on the second exposure glass.

5. The document feeder according to claim 1, further comprising a support configured to support the contact glass on the top face of the apparatus body, wherein the at least two recesses are formed on the support, and wherein the at least two second protrusions are formed on the frame via a cover disposed on the frame.

6. An image forming apparatus comprising:

the apparatus body; and the document feeder according to claim 1, disposed on a top face of the apparatus body and openable and closable about one end side of the apparatus body in a direction orthogonal to the document conveying direction.

7. The document feeder according to claim 1, wherein the sheet conveying guide includes at least a portion, movable in a vertical direction, wherein a spring is configured to bias at least the portion toward the exposure glass when the document feeder is in a closed state with respect to the apparatus body.

8. The document feeder according to claim 1, wherein the at least two second protrusions are configured to contact the exposure glass between the pair of first protrusions when the document feeder is in the closed state with respect to the apparatus body.

9. The document feeder according to claim 1, wherein each of the pairs of first protrusions includes a pair of inwardly concaved portions disposed facing each other across the direction perpendicular to the lateral direction of the contact glass, and wherein each of the at least two second protrusions includes two outwardly convex portions, each of the two outwardly convex portions of each of the at least two second protrusions being disposed to face and contact a corresponding sloped face of a respective one of each of the respective the pairs of inwardly concaved portions when the document feeder is in the closed state with respect to the apparatus body.

10. The document feeder according to claim 1, wherein each of the at least two recesses are disposed on the apparatus body at both ends of the exposure glass and each of the at least two recesses are respectively formed by a pair of first protrusions, and wherein each of the at least two second protrusions is configured to be fitted and positioned between the respective pair of first protrusions of a respective one of the at least two recesses when the document feeder is in the closed state with respect to the apparatus body.

11. The document feeder according to claim 1, wherein the at least two recesses and the at least two second protrusions aid in accurately positioning the document feeder with respect to the apparatus body of an image forming apparatus.

12. A document feeder comprising:

a sheet conveying guide disposed facing an exposure glass disposed on a top face of an apparatus body of an image forming apparatus and configured to guide an original document passing over the exposure glass when the document feeder is in a closed state with respect to the apparatus body;

at least one recess disposed on the apparatus body at either end of the exposure glass in a lateral direction orthogonal to a document conveying direction of the original document;

a frame, openable and closable about one end side of the apparatus body of the image forming apparatus in the lateral direction, the frame being configured to hold the sheet conveying guide such that the sheet conveying guide is movable in a vertical direction; and at least one protrusion disposed on the frame at a position facing the at least one recess, the sheet conveying guide and the frame being secured to each other and the at least one recess and the at least one protrusion being engaged with each other when the document feeder is in the closed state with respect to the apparatus body, wherein the at least one recess includes two inwardly concaved portions disposed facing each other across the direction perpendicular to the lateral direction of the contact glass, wherein each of the two inwardly concaved portions has a sloped face inclining downwardly toward the contact glass, wherein the at least one protrusion includes two outwardly convex portions, each of the two outwardly convex portions of the at least one protrusion being disposed to face and contact a corresponding sloped face of a respective one of the two inwardly concaved portions when the document feeder is in the closed state with respect to the apparatus body, and wherein the at least one second protrusion is disposed at one of the one end side and the opposed end side of the exposure glass in the lateral direction and an outside area of a region of the exposure glass over which the original document passes, when the document feeder is in the closed state with respect to the apparatus body.

13. The document feeder according to claim 12, wherein each of the two inwardly concaved portions includes a curve-shaped boundary between the sloped face and the top face of the apparatus body.

14. An image forming apparatus comprising:

the apparatus body; and the document feeder according to claim 12, disposed on a top face of the apparatus body and openable and closable about one end side of the apparatus body in a direction orthogonal to the document conveying direction.

15. The document feeder according to claim 12, wherein the sheet conveying guide includes at least a portion, movable in a vertical direction, wherein a spring is configured to bias at least the portion toward the exposure glass when the document feeder is in a closed state with respect to the apparatus body.

16. The document feeder according to claim 12, wherein the at least one recess includes at least two recesses and wherein the at least one second protrusion includes at least two second protrusions, each of the at least two recesses being disposed on the apparatus body at both ends of the exposure glass, and each of the at least two second protrusions being configured to be fitted and positioned between the two outwardly convex portions of a respective one of the at least two recesses when the document feeder is in the closed state with respect to the apparatus body.

17. The document feeder according to claim 12, wherein the at least one recess and the at least one protrusion aid in accurately positioning the document feeder with respect to the apparatus body of an image forming apparatus.

18. A document feeder comprising:

a sheet conveying guide disposed facing an exposure glass disposed on a top face of an apparatus body of an image forming apparatus and configured to guide an original document passing over the exposure glass when the document feeder is in a closed state with respect to the apparatus body;

at least one recess disposed on the apparatus body at at least one end of the exposure glass, the at least one recess being formed by a pair of first protrusions;

a frame, openable and closable about one end side of the apparatus body of the image forming apparatus, the frame being configured to hold the sheet conveying guide such that the sheet conveying guide is movable in a vertical direction; and at least one second protrusion disposed on the frame at a position facing the at least one recess, the at least one second protrusion being configured to fit between the pair of first protrusions when the document feeder is in the closed state with respect to the apparatus body, wherein the pair of first protrusions includes a pair of inwardly concaved portions disposed facing each other across the direction perpendicular to the lateral direction of the contact glass, and wherein the at least one second protrusion includes two outwardly convex portions, each of the two outwardly convex portions of the at least one second protrusion being disposed to face and contact a corresponding sloped face of a respective one of the pair of inwardly concaved portions when the document feeder is in the closed state with respect to the apparatus body.

19. An image forming apparatus comprising:

the apparatus body; and the document feeder according to claim 18, disposed on a top face of the apparatus body and openable and closable about one end side of the apparatus body in a direction orthogonal to the document conveying direction.

* * * * *